US008002171B2

(12) United States Patent
Ryan et al.

(10) Patent No.: US 8,002,171 B2
(45) Date of Patent: Aug. 23, 2011

(54) PACKAGE WITH RECLOSEABLE DISPENSER

(75) Inventors: Michael D. Ryan, Media, PA (US); Angela E. Learn, Gilbertsville, PA (US); Felicia A. Pinkstone, Aston, PA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 12/508,741

(22) Filed: Jul. 24, 2009

(65) Prior Publication Data

US 2010/0019022 A1 Jan. 28, 2010

Related U.S. Application Data

(60) Provisional application No. 61/083,655, filed on Jul. 25, 2008.

(51) Int. Cl.
*B65D 5/00* (2006.01)
*B23P 19/00* (2006.01)

(52) U.S. Cl. ..... 229/122; 229/160.1; 29/426.2

(58) Field of Classification Search ..... 229/131.1, 229/126, 133, 125.34; 29/426.2
See application file for complete search history.

(56) References Cited

U.S. PATENT DOCUMENTS 4,768,703 A * 9/1988 Sosler et al. ..... 229/123.1
6,869,009 B2 3/2005 Sutherland et al.
7,703,665 B2 4/2010 McGowan

FOREIGN PATENT DOCUMENTS

EP 406556 A1 * 1/1991

* cited by examiner

*Primary Examiner* — Nathan J Newhouse
*Assistant Examiner* — Christopher Demeree
(74) *Attorney, Agent, or Firm* — Womble Carlyle Sandridge & Rice, PLLC

(57) ABSTRACT

A package having a dispenser with reclosable features. The package has a reclosable flap that is positionable between an open position for accessing products within the package and a closed position preventing access to products within the package.

70 Claims, 16 Drawing Sheets

PACKAGE WITH RECLOSEABLE DISPENSER

CROSS-REFERENCE TO RELATED APPLICATION

This application claims the benefit of U.S. Provisional Application No. 61/083,655, filed on Jul. 25, 2008, the entire disclosure of which is incorporated herein by reference.

BACKGROUND OF THE DISCLOSURE

The present disclosure generally relates to a package for holding food products. More specifically, the present disclosure relates to a package having a reclosable dispenser.

SUMMARY OF THE DISCLOSURE

In one aspect, the disclosure is generally directed to a package for holding a food product. The package comprises a carton and an inner layer at least partially attached to the carton. The inner layer comprises an inner layer flap for creating a opening for accessing the food product, and the carton comprises a movable carton flap. An adhesive layer is adhered to the carton flap and the inner layer flap. A reclosable flap of the package comprises the inner layer flap, at least a portion of the adhesive layer extending beyond the edge of the inner layer flap, and the carton flap. The reclosable flap is movable between an open position creating a dispensing opening for providing access to the food product and a closed position preventing access to the food product in the package.

In another aspect, the disclosure is generally directed to a package that has a reclosable flap that is movable between an open position creating a dispensing opening for providing access to a product in the package and a closed position preventing access to the product in the package. The package includes a closure mechanism that maintains the reclosable flap in the closed position.

According to another aspect, the disclosure is generally directed to a package including a carton, an inner layer attached to the carton and a tray secured to the carton and the inner layer. A reclosable dispenser flap is formed in the carton and the inner layer is movable between an open position creating a dispensing opening for providing access to a product in the package and a closed position preventing access to the product in the package. The package includes a closure mechanism that maintains the reclosable flap in the closed position.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding reference characters indicate corresponding parts throughout the several views of the drawings.

DETAILED DESCRIPTION OF EXEMPLARY EMBODIMENTS

The present disclosure generally relates to a package having a reclosable dispenser opening. Features of the present disclosure can be used, for example, in packages, containers, cartons, or the like, that contain products, such as food products (e.g., crackers, cookies, sliced meat, cold cuts, etc.) or non-food products (e.g. skin care/personal care products such as diaper wipes or moist towelettes, consumer products such as crayons, garden products such as potting soil, or any other product). The package of the present disclosure could be used to contain any product, material, substance that is capable of being used in a reclosable package. In this specification, the terms "lower," "bottom," "upper", "top", "front", and "back" indicate orientations determined in relation to fully erected cartons.

Figure 1:
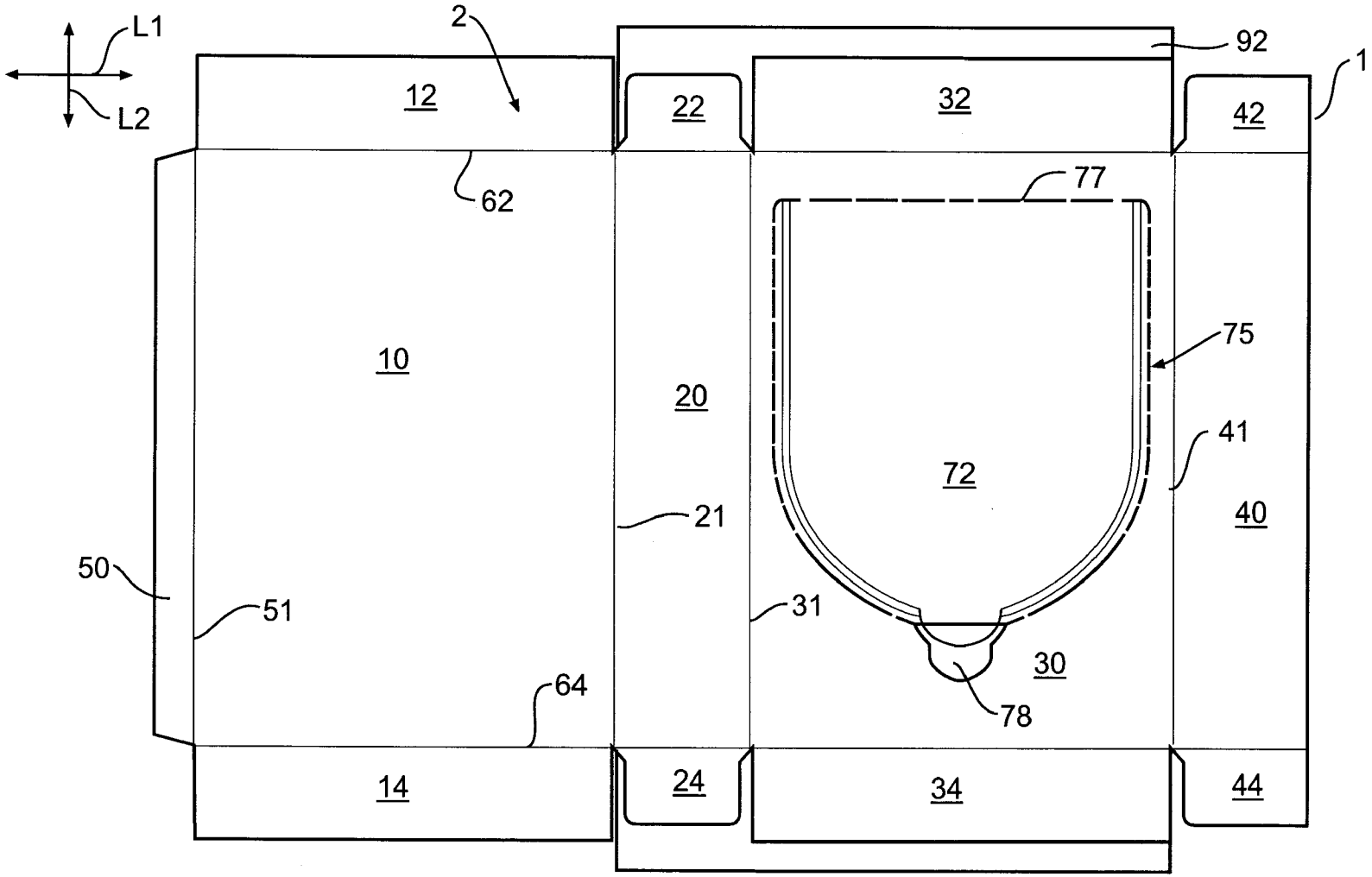
FIG. 1 is a plan view of a blank according to an embodiment of the disclosure.

FIG. 1 is a plan view of the interior side 2 of a blank, generally indicated at 1, used to form a carton 3 (FIG. 2) according to one exemplary embodiment of a package 7. In the embodiment of FIGS. 1-4, the package 7 includes an inner layer of material 9 (FIG. 3) in the form of a liner or bag. The package 7 according to the first embodiment comprises the carton 3 and liner 9 in the interior of the carton. Food products (not shown) are held within the liner 9 in the carton 3. The package 7 has a reclosable dispenser flap 11 that allows access to the food products held within the liner. The reclosable dispenser flap 11 can have resealable features to preserve the freshness of the food product in the package when the flap closed.

The blank 1 has a longitudinal axis L1 and a lateral axis L2. In the illustrated embodiment, the blank 1 comprises a back panel 10 foldably connected to a first side panel 20 at a first transverse fold line 21, a front panel or dispenser panel 30 foldably connected to the first side panel 20 at a second transverse fold line 31, and a second side panel 40 foldably connected to the front panel 30 at a third transverse fold line 41. An adhesive flap 50 may be foldably connected to the back panel 10 at a fourth transverse fold line 51.

In the illustrated embodiment, the back panel 10 is foldably connected to a bottom end flap 12 and a top end flap 14. The first side panel 20 is foldably connected to a bottom end flap 22 and a top end flap 24. The front panel 30 is foldably connected to a bottom end flap 32 and a top end flap 34. The second side panel 40 is foldably connected to a bottom end flap 42 and a top end flap 44. The bottom end flaps 12, 22, 32, 42 extend along a bottom or first marginal area of the blank 1, and may be foldably connected along a first generally longitudinally extending fold line 62. The top end flaps 14, 24, 34, 44 extend along a top or second marginal area of the blank 1, and may be foldably connected along a second generally longitudinally extending fold line 64.

When the carton 3 is erected from the blank 1, the top end flaps 14, 24, 34, 44 at least partially overlap and close a top end 57 (FIG. 2) of the carton, and the bottom flaps 12, 22, 32, 42 at least partially overlap and close a bottom end 59 of the carton. The carton 3 may be otherwise arranged such that the top, bottom, front, and back of the carton correspond to other orientations of the carton. In the illustrated embodiment, the carton 3 formed from the blank 1 is generally parallelepiped in shape having four corners, but the carton could be otherwise shaped to have more or less than four corners without departing from the disclosure.

The front panel 30 has an outer flap or carton flap 72 defined at least in part by a tear line 75 in the blank 1. The carton flap 72 is hingedly connected to the front panel 30 by a longitudinal fold line 77. The blank 1 has an opening 78 in the front panel 30 adjacent an edge of the flap 72. The carton flap 72 can be otherwise shaped and/or arranged.

In the illustrated embodiment, the liner 9 is a bag for lining the interior surface 2 of the blank 1. The liner 9 forms an inner layer of the package 7 that is attached to the carton 3. The liner 9 has an inner flap or liner flap 82 (FIG. 4) defined by a tear line and a fold line in the liner. The liner 9 has a marginal portion 84 that extends outward from the liner flap 82. In the illustrated embodiment, the liner 9 is a thermoplastic polymer film (e.g., polyethylene terephthalate (PET) film) but the liner could comprise any other suitable material. Alternatively, the liner 9 could be a single layer of material (e.g., a patch) attached to the front panel 30 without departing from the scope of the disclosure. The liner 9 can be otherwise shaped and/or arranged. The liner 9 may be substantially transparent, if desired.

Figure 2:
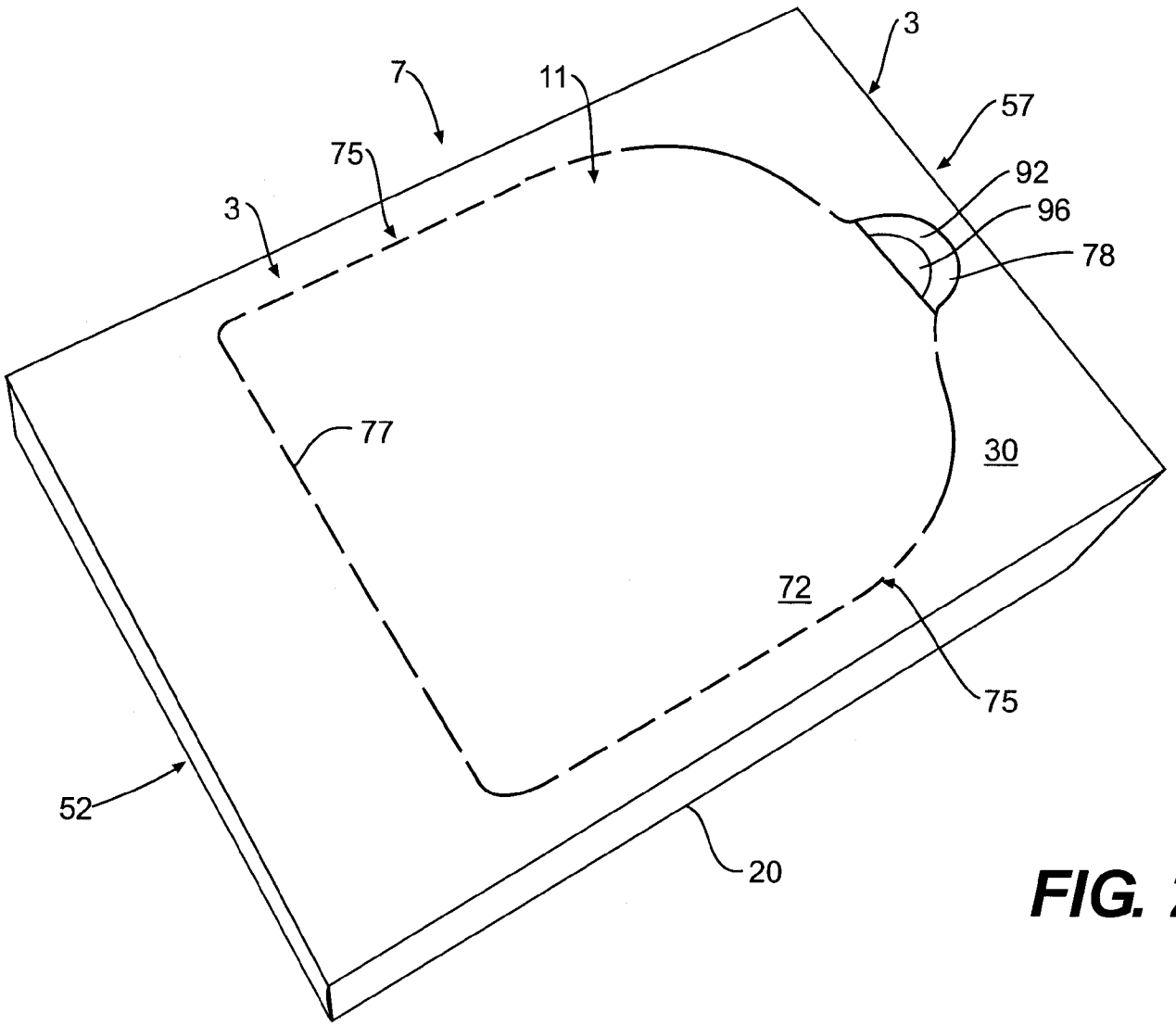
FIG. 2 is a perspective view of a package formed from the blank of FIG. 1.

In the illustrated embodiment, an intermediate layer of material 92 (FIG. 4) such as a label, an adhesive film or a patch 92 is disposed between the liner 9 and the front panel 30 of the blank. The label 92 may be substantially transparent, if desired. In one embodiment, the label 92 has a surface area greater than the surface area of the carton flap 72 and the liner flap 82. In the embodiment of FIG. 1, the label 92 covers the surface area of the front panel 30, side panel 22, and end flaps 22, 24, 32, 34, but the label could be smaller or larger without departing from this disclosure. One side of the label 92 is adhesively secured to the front panel 30 and the other side of the label is adhesively secured to the liner 9. As shown in FIG. 4, the label 92 has an intermediate flap or label flap 94 adhered to the carton flap 72 of the front panel 30. The label flap 94 has a marginal portion 98 that extends beyond the edge of the liner flap 82. The label 92 includes a tab portion 96 (FIGS. 2 and 3) that is free from adhesive attachment to both the carton 3 and the liner 9. As shown in FIG. 2, the tab portion 96 of the label extends from an edge of the carton flap 72 and is positioned above a portion of the liner 9 that covers the opening 78 in the carton 3. The tab portion 96 could be otherwise shaped, arranged, or omitted without departing from the disclosure. The label flap 94, the carton flap 72, and the liner flap 82 are adhered together to form the dispenser flap 11 of the package 7. The tab portion 96 forms an actuation flap that is positioned for actuation of the dispenser flap 11 of the package 7.

In the illustrated embodiment, the label 92 is a biaxially oriented polypropylene (BOPP) material, but other suitable materials could be used. The adhesive on one or both sides of the label 92 could be a releasable adhesive that allows separations of the label from the liner 9 and also provides resealing of the package 1 when the flap 11 is reclosed. Any suitable adhesive (e.g., pressure sensitive adhesive), can be used to provide the desired resealing capability. Also, the dispenser flap 11 could have other attachment and/or sealing mechanisms to allow the flap to be reclosed and to preserve the freshness of the contents in the package 1. Further, the label 92 could have releasable adhesive on portions of the label and non-releasable adhesive on other portions of the label.

In accordance with one example, the package 7 can be formed by forming the carton 3 from the blank 1. The label 92 can be placed over respective panels of the blank. The carton 3 is formed by folding the panels 10, 20, 30, 40, relative to fold lines 21, 31, 41 and attaching adhesive flap 50 to the second side panel 40 to form a generally tubular sleeve. The liner 9 can be positioned on the interior of the panels 10, 20, 30, 40 and has generally open ends when the tubular sleeve is formed. The liner 9 can be attached to one or more of the panels 10, 20, 30, 40 by the adhesive on the label and/or other adhesives and attachment mechanisms or may be free from attachment to the panels. Furthermore, the liner 9 can be a single layer or can comprise a bag or other container. Food products (e.g., cookies, crackers, etc.) are placed inside the liner 9 and the liner can be closed by conventional closing methods (e.g., adhesive, crimp seals, etc.). Next the end flaps 14, 24, 34, 44 are folded to close the top end 57 of the carton 3 and the end flaps 12, 22, 32, 42, are folded to close the bottom end 59 of the carton. The assembled and closed package 7 (FIG. 2) can be shipped to a point-of-sale location (e.g., grocery store).

Figure 3:
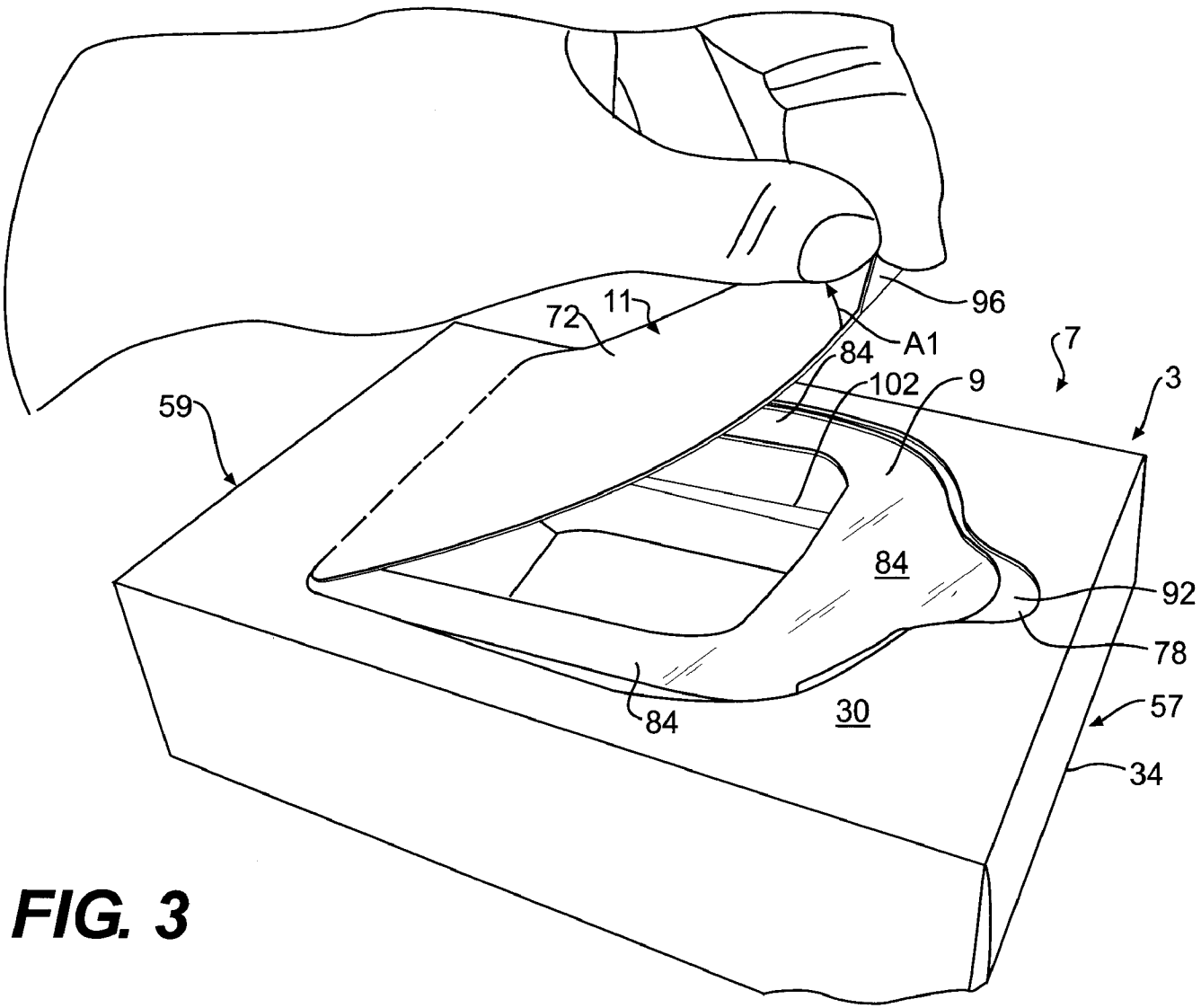
FIGS. 3 and 4 show the package of FIG. 2 with a dispenser flap of the package in an open position.
Figure 4:
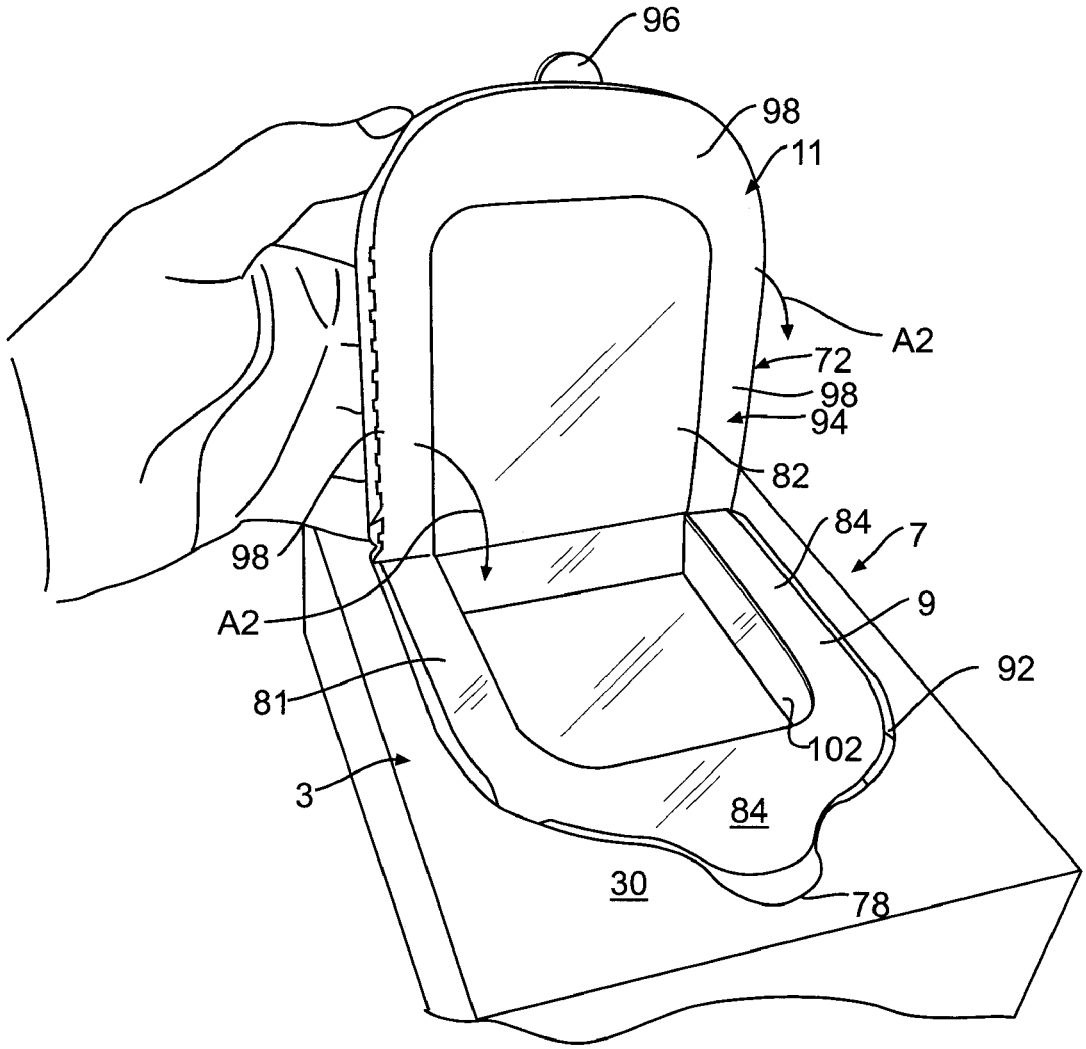

The package 7 can be opened by grasping the tab 96 of the dispenser flap 11 and pulling the flap upward in the direction of arrow A1 (FIG. 3). Opening the flap 11 creates a dispenser opening 102 in the package 7 by tearing tear lines. Food products (not shown) can be removed from the package 7 through the dispenser opening 102.

The dispenser opening 102 of the package 7 can be closed by downwardly folding the reclosable flap 11 in the direction of arrow A2 (FIG. 4). When the flap 11 is closed, the marginal portion 98 of the label flap 94 is returned to face-to-face contact with the marginal portion 84 of the liner 9. The releasable adhesive on the marginal portion 98 releasably secures the flap 11 in the closed position and creates a seal that preserves the freshness of the unused food product remaining in the package 1. The flap 11 can have other configurations with other attachment and sealing mechanisms without departing from the disclosure.

Figure 5:
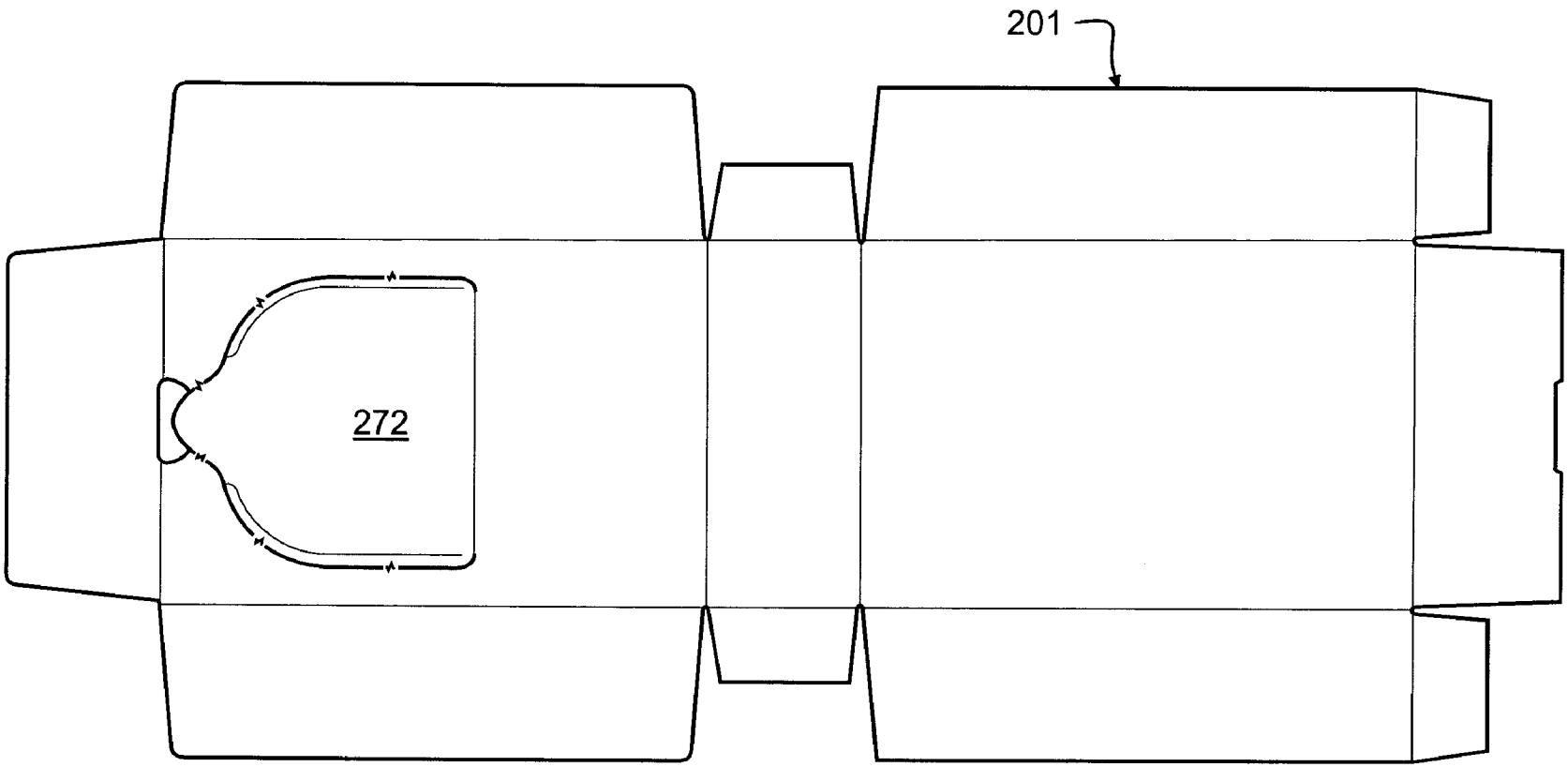
FIG. 5 is a plan view of a blank of an alternative embodiment of the disclosure.

FIG. 5 illustrates an alternative embodiment of a blank 201 used to form a carton similar to the carton 3 of the first embodiment. Like or similar reference numbers are used to indicate similar or identical components as the previous embodiment. The dispenser flap 272 of the blank 201 is configured to have an alternative orientation and position. Further, the blank 201 has different flap closing configuration and is a different size than the blank 1 of the first embodiment. The blank 201 can be used to form a carton that is used in a package in a similar manner as the carton 3 and package 7 described above.

Figure 6:
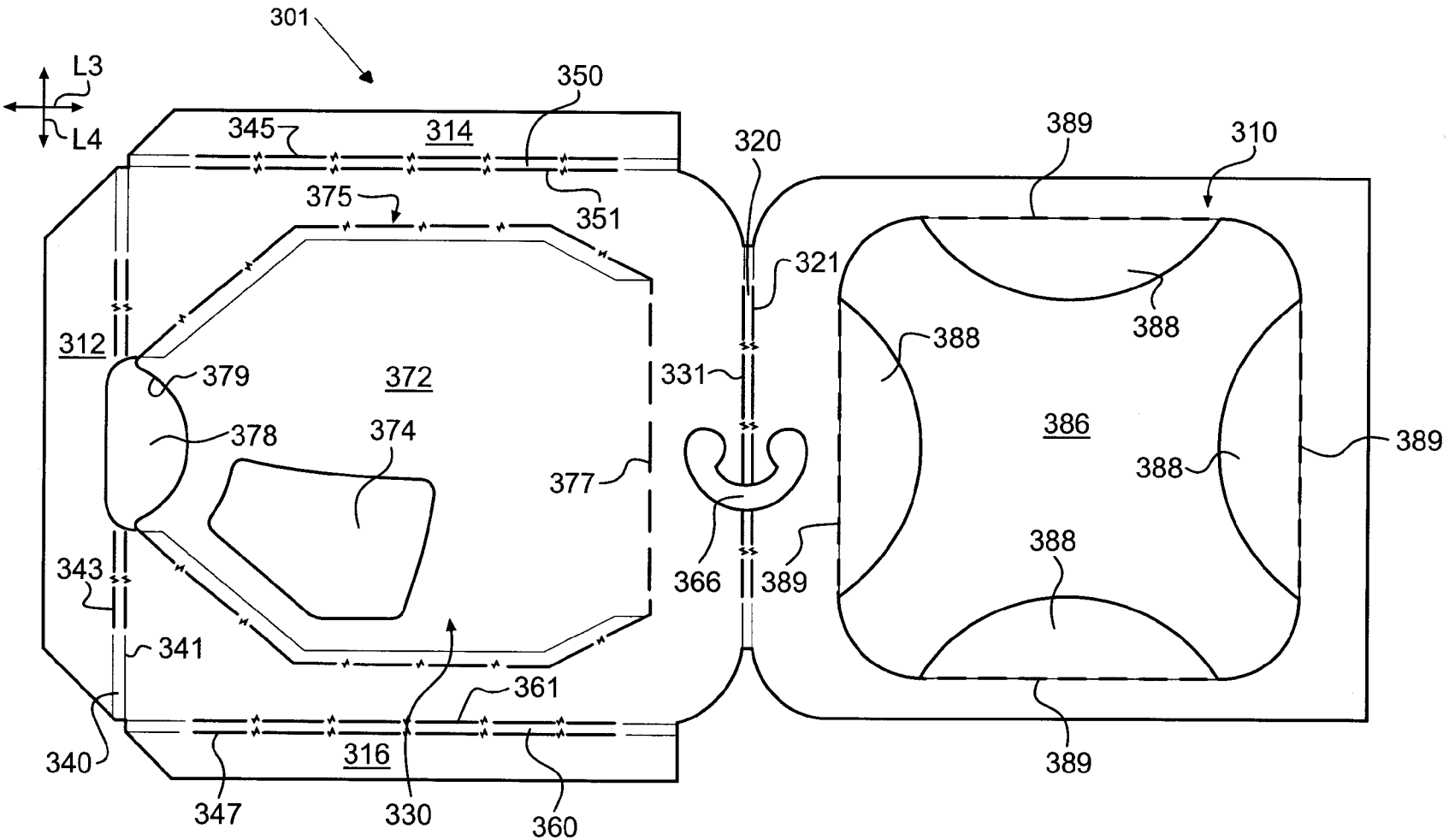
FIGS. 6-8 show a blank and a tray according to an alternative embodiment of the disclosure.
Figure 7:
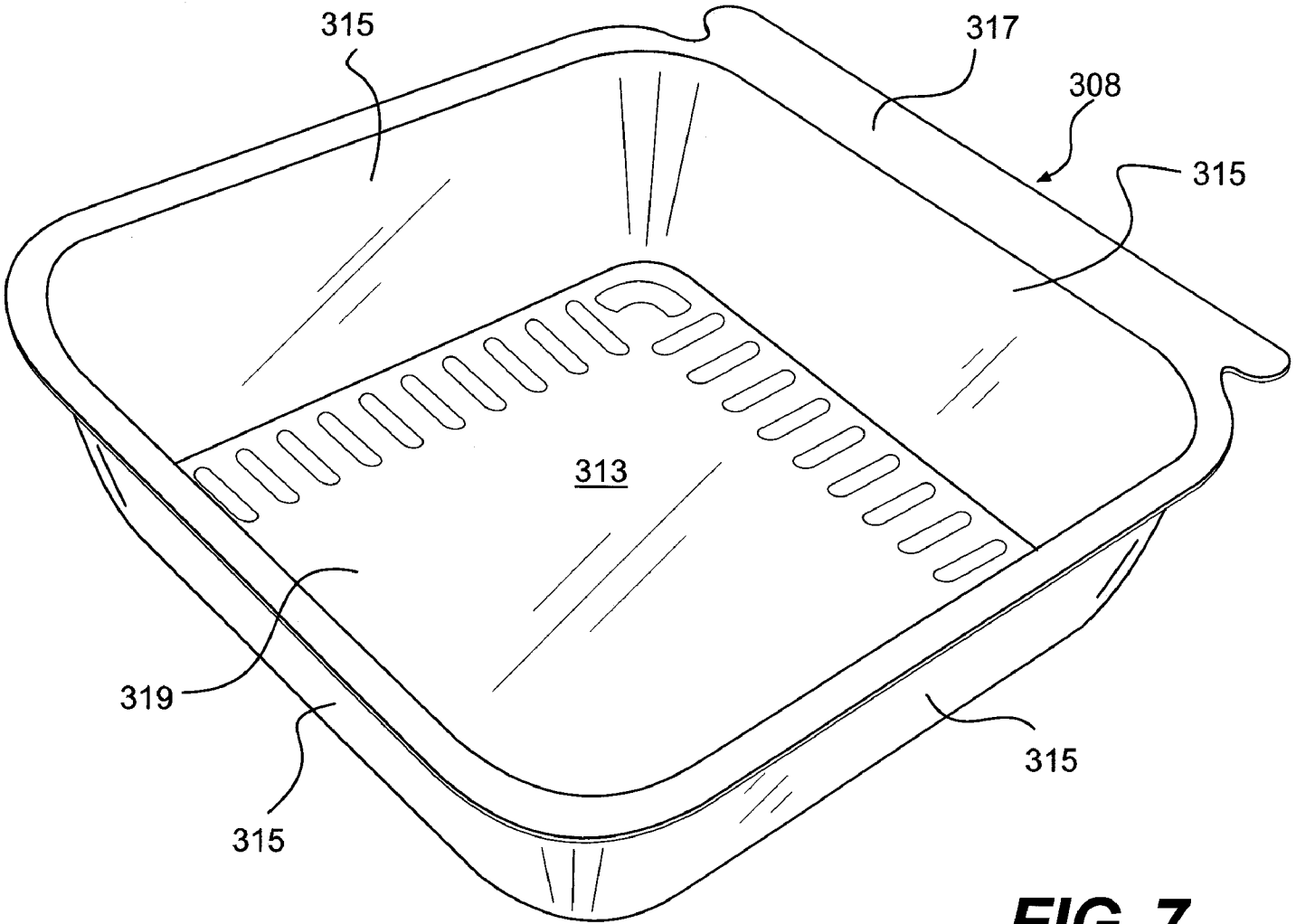
Figure 8:
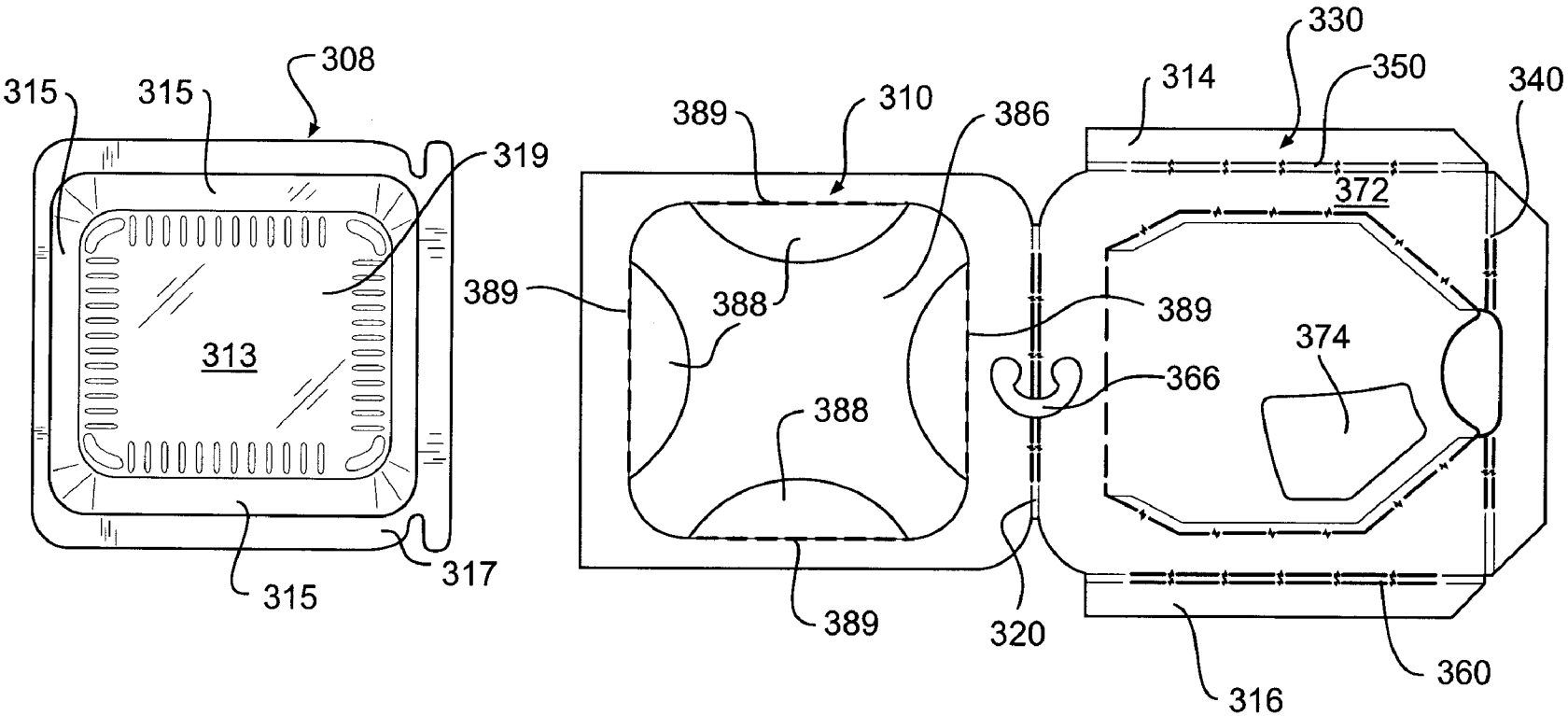
Figure 13:
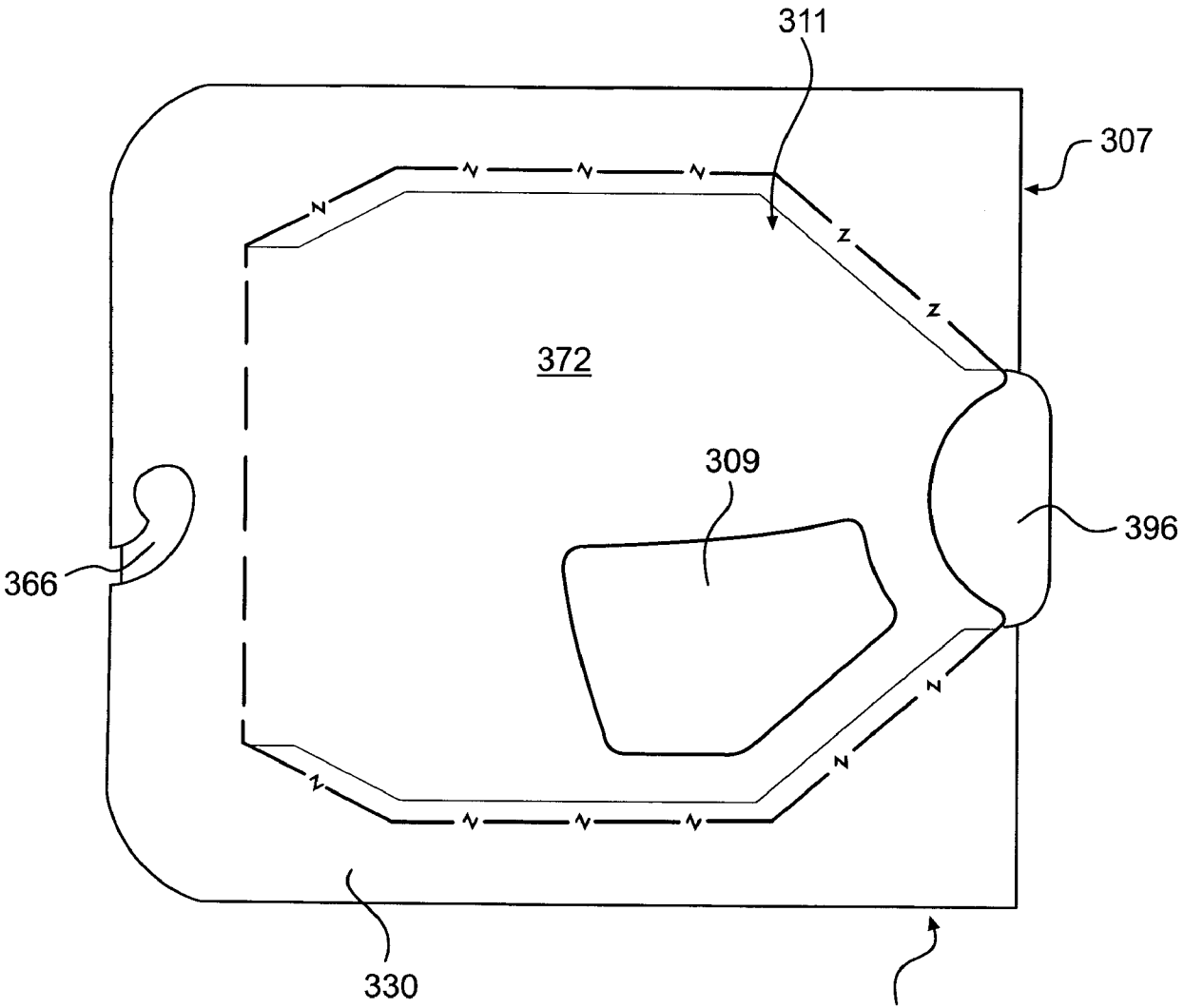
FIGS. 13 and 14 are perspective views of the package formed from the blank and tray of FIGS. 6-8.
Figure 14:
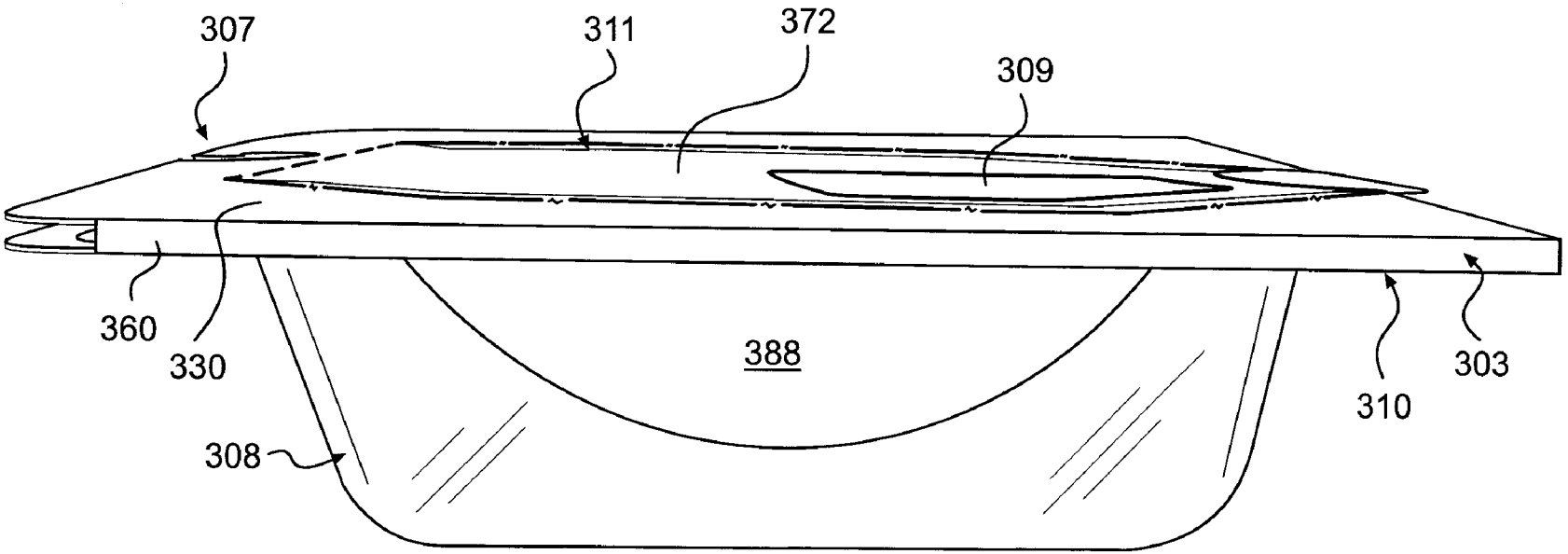

FIG. 6 illustrates an alternative embodiment of a blank 301 used to form a carton 303 (FIG. 13) of a package 307. Like or similar reference numbers are used to indicate similar or identical components as the first embodiment. The package 307 comprises the carton 303 attached to a tray 308 (FIG. 7) containing a food product (not shown). In the illustrated embodiment, the tray 308 is a transparent plastic tray having a bottom wall 313, side walls 315, and a flange 317 extending around the perimeter of the side walls. The tray 308 could be materials other than plastic and/or may be otherwise shaped and arranged without departing from the disclosure. Further, the tray 308 may be a container or package that is otherwise shaped (e.g., that is not a tray, having, for example, four side walls, a bottom wall, and an open top) without departing from the disclosure. The package 307 includes a reclosable dispenser flap 311 (FIG. 13), comprising a carton flap 372 and a liner flap 382, for accessing the food product (e.g., sliced meats, cold cuts, or other food products) located within the interior space 319 of the tray. As with the previous embodiment, the dispenser flap 311 is reclosable to preserve the freshness of unused food product that remains in the tray 308.

As shown in FIG. 6, the blank 301 has a longitudinal axis L3 and a lateral axis L4. The blank 301 comprises a bottom panel 310 foldably connected to a first side panel 320 at a first lateral fold line 321. The first side panel 320 is foldably connected to a top panel or dispenser panel 330 at a second lateral fold line 331. A second side panel 340 is foldably connected to the top panel 330 at a third lateral fold lines 341. A third side panel 350 is foldably connected to the top panel 330 at a first longitudinal fold line 351. A fourth side panel 360 is foldably connected to the top panel 330 at a second longitudinal fold line 361. Adhesive flaps 312, 314, 316 are foldably connected to respective side panels 340, 350, 360 at respective fold lines 343, 345, 347. The blank 301 can have other panel and flap arrangements without departing from the scope of this disclosure. For example, side panels 340, 350, 360 and adhesive flaps 312, 314, 316 could be omitted without departing from the disclosure.

The blank 301 has an outer flap or carton flap 372 defined at least in part by a tear line 375 in the top panel 330. The dispenser flap 372 is foldably connected to the top panel 330 by a lateral fold line 377. In the illustrated embodiment, the carton flap 372 has an opening 374 that provides a view of an interior of the carton 330, but the opening can be omitted or be otherwise shaped and/or arranged without departing from the disclosure. The top panel 330 has an opening 378 adjacent an edge 379 of the dispenser flap 372.

The bottom panel 310 includes a opening 386 and four retention flaps 388 adjacent the opening. Each retention flap 388 is foldably connected to the bottom panel 310 at a respective fold line 389. When the retention flaps 388 are respectively folded at fold lines 389 to be generally perpendicular to the bottom panel 310, the opening 386 is generally rectangular in shape. The retention flaps 388 can provide surface area for the presentation of advertisement, labels, or other information on the package 307. The retention flaps 388 could be omitted or otherwise shaped and arranged without departing from the disclosure.

The blank 301 includes an opening 366 that is at least partially in the bottom panel 310, the side panel 320, and the top panel 330. The opening 366 could be omitted or otherwise shaped and/or arranged without departing from the disclosure.

Figure 9:
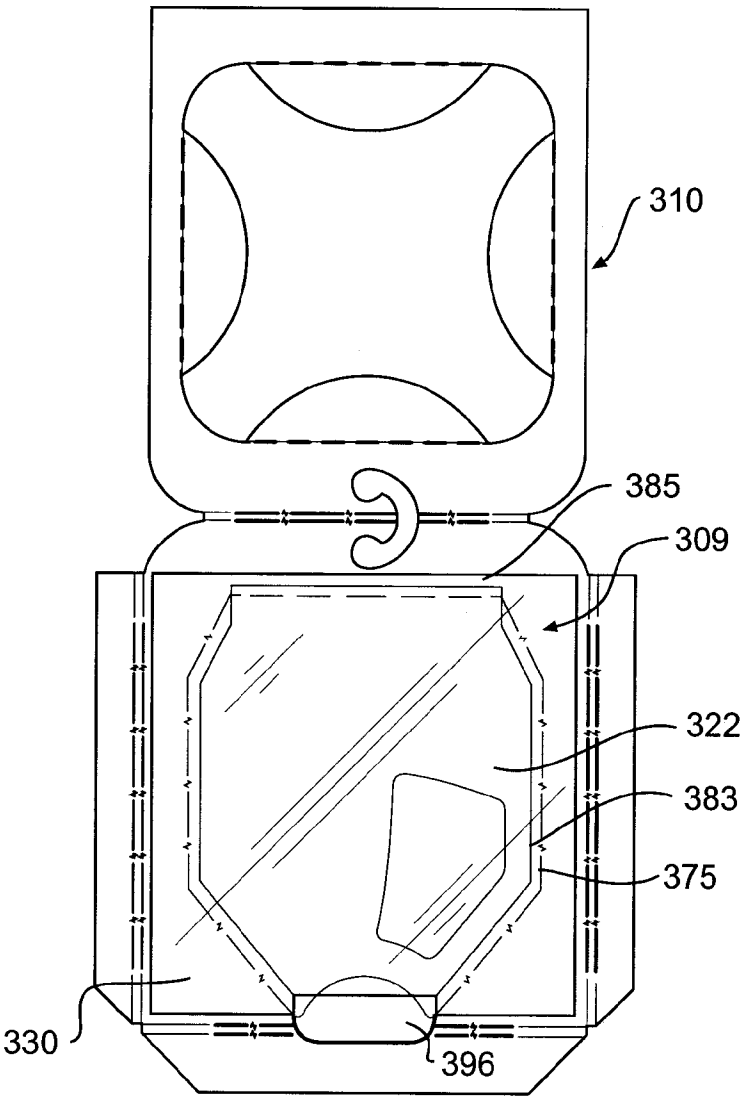
FIGS. 9-12 illustrate a process for forming a package from the blank and tray of FIGS. 6-8.
Figure 9:
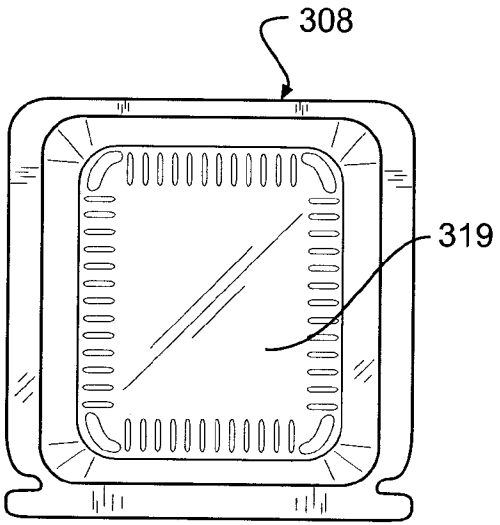

FIGS. 8-14 illustrate formation of the blank 301 into the carton 303 and attachment of the carton 303 to the tray 308. An inner layer of material or liner 309 (FIG. 9) is placed on an interior surface of the top panel 330. The liner 309 is attached to the top panel 330 by adhesive or by an intermediate layer of material (e.g., a patch or label, not shown) as in the first embodiment. The liner 309 includes an inner flap or liner flap 382 at least partially defined by a cut line 383 and a fold line 385. As shown in FIG. 9, the cut line 383 of the liner flap 382 of the liner 309 is spaced inward from the tear or cut line 375 of the carton flap 372 of the top panel 330. The liner 309 has an actuation tab 396 located in the opening 378 of the top panel 330. The liner 309 can be any suitable material for forming a sealed lid attached to the tray 308, such as a polymer film, and may be substantially transparent if desired.

Figure 10:
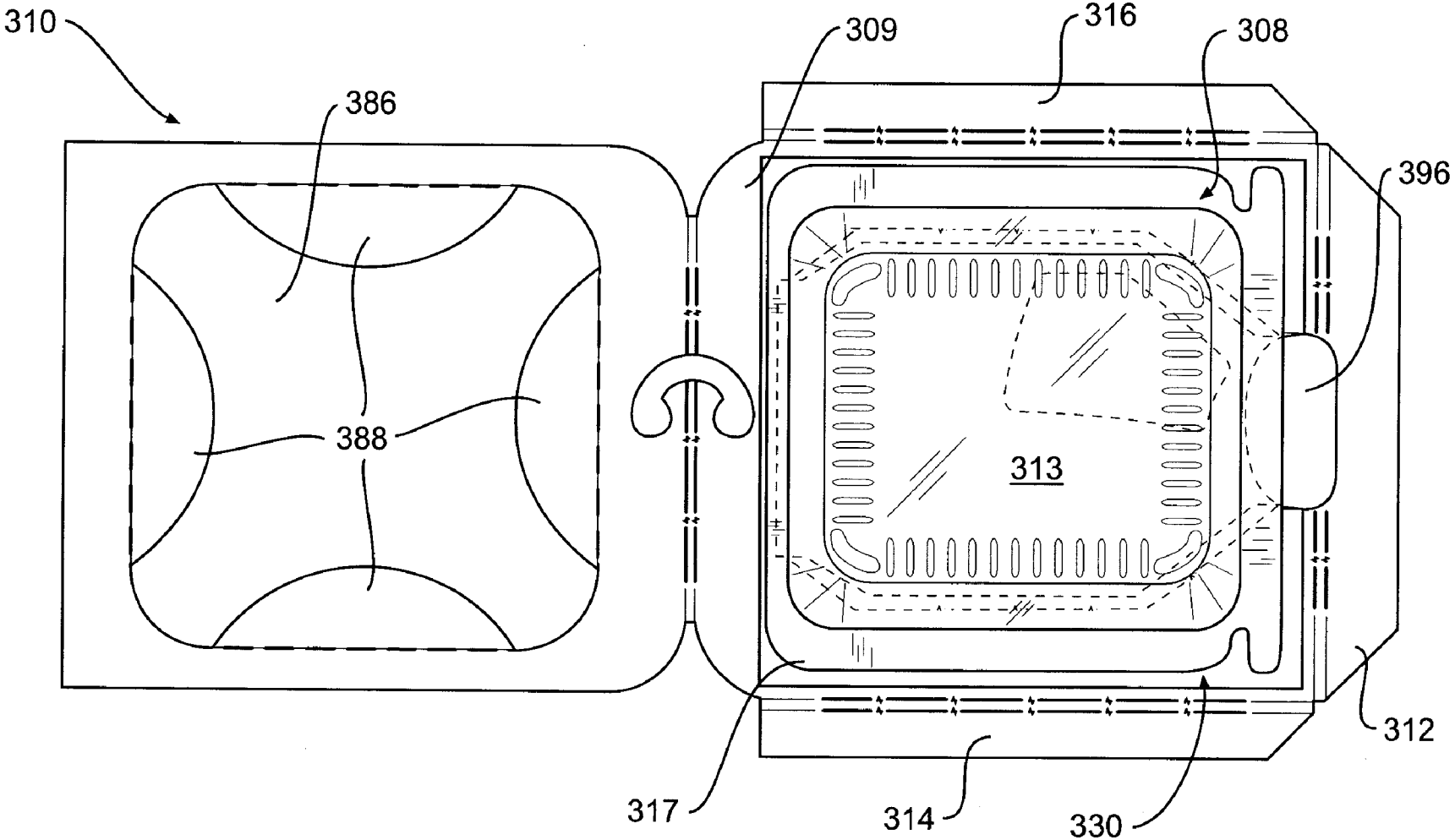
Figure 11:
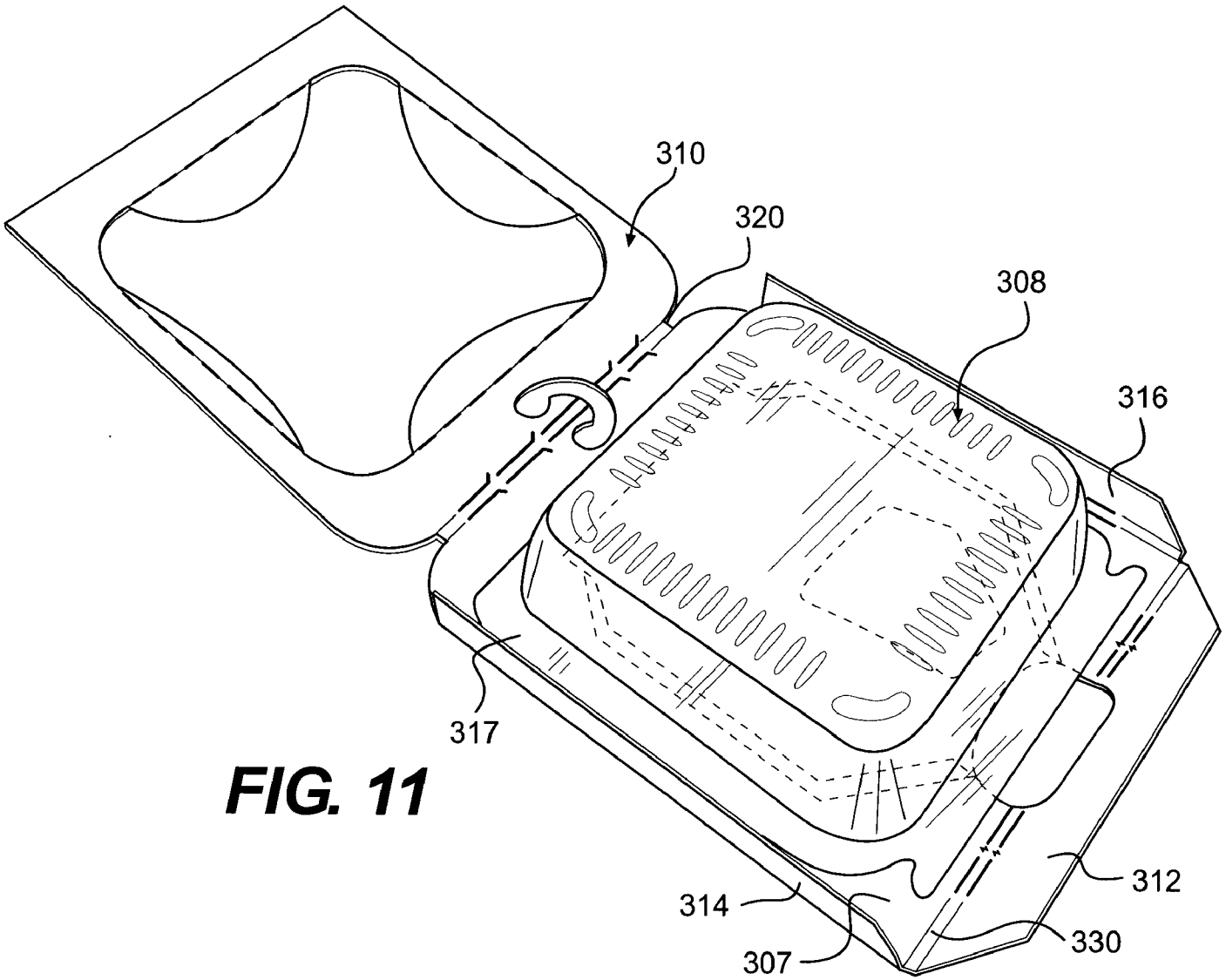
Figure 12:
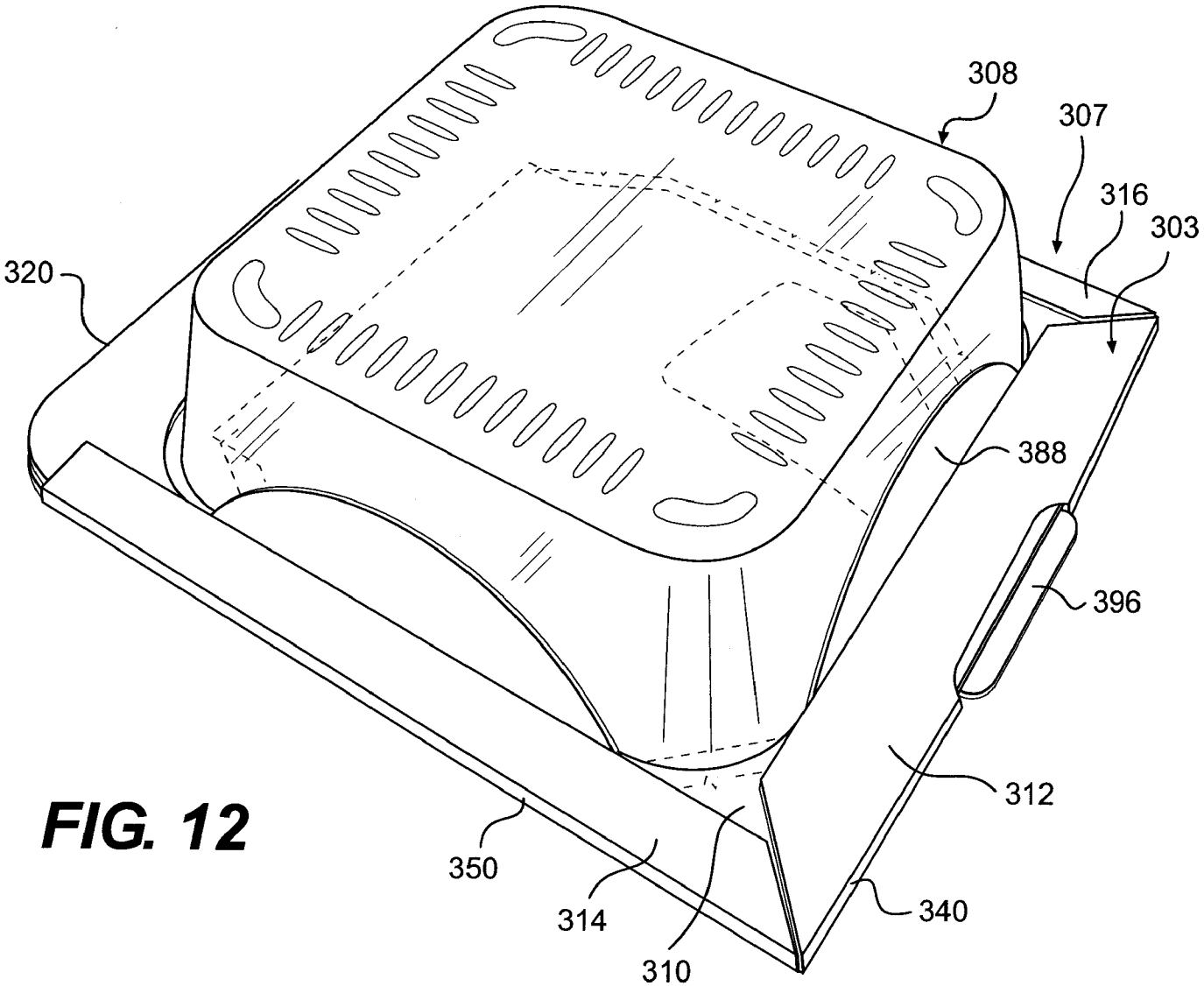

As shown in FIG. 10, the tray 308 can be attached to the liner 309 by placing the flange 317 in face-to-face contact with the liner 309. An adhesive (e.g., releasable or non-releasable) can be applied between the top surface of the flange 317 and the liner 309 so that the liner forms a lid that substantially seals and preserves the freshness of the food products in the tray 308. Next, the bottom panel 310 is folded over the inverted tray 308 so that the bottom wall 313 and part of the side walls 315 are received through the opening 386. In this position, side panel 320 is generally perpendicular relative to the top panel 330 and the bottom panel 310. The retention flaps 388 are outwardly folded to expand the opening 386 and are biased against the side walls 315 of the tray 308. Next, the adhesive flaps 312, 314, 316 are folded to position a respective side panel 340, 350, 360 about respective fold lines 341, 351, 361 so that the side panels are generally perpendicular relative to the top panel 330. As shown in FIGS. 11 and 12, the adhesive flaps 312, 314, 316 are further folded about respective fold lines 343, 345, 347 to position the adhesive flaps in generally face-to-face contact with the bottom panel 310. The adhesive flaps 312, 314, 316 can be secured to the bottom panel 310. In the illustrated embodiment, the flange 313 of the tray is held between the spaced apart top and bottom panels 330, 310 of the carton 303, but the tray could be attached to the carton by other configurations and attachment mechanisms.

Figure 15:
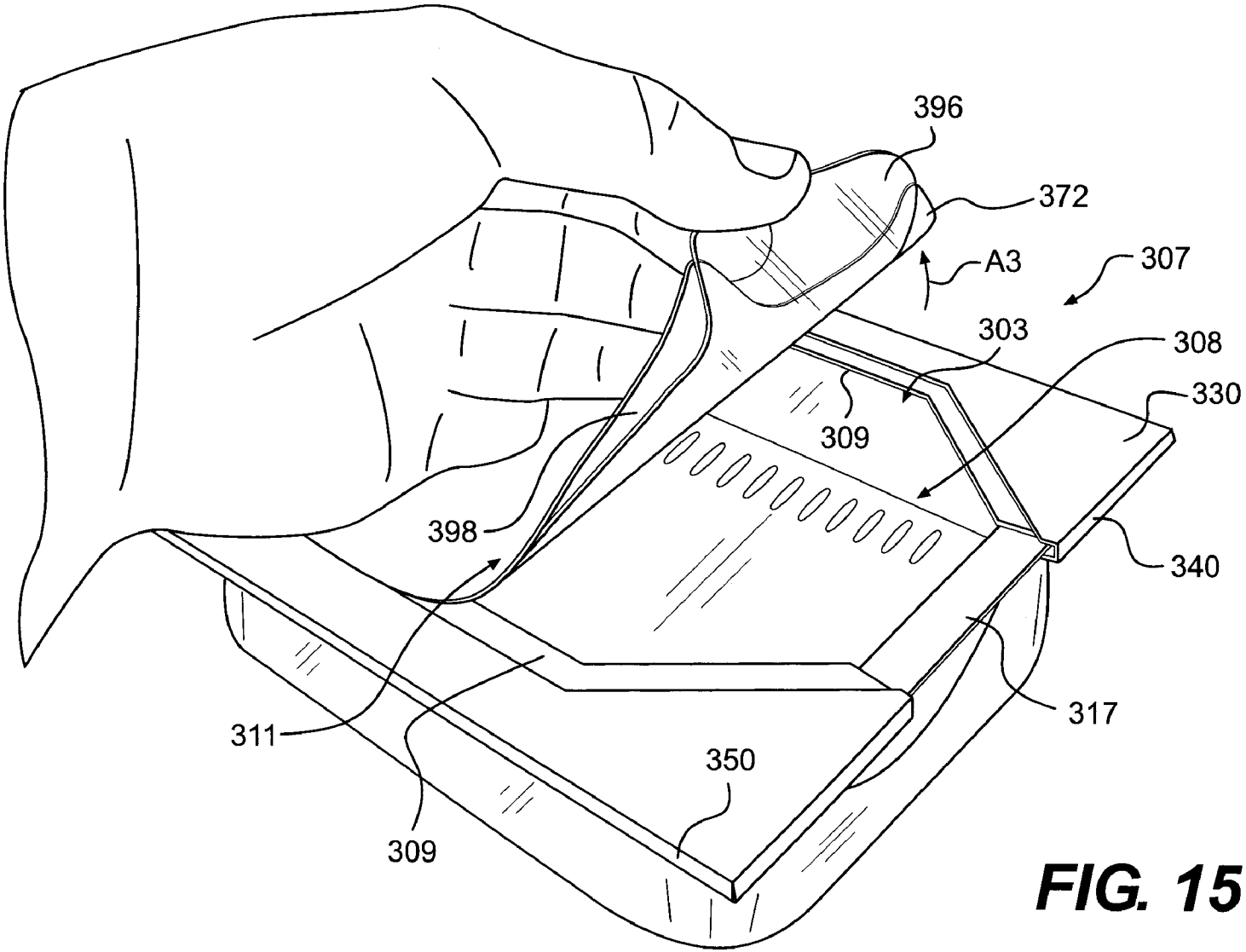
FIGS. 15 and 16 illustrate a process of opening a dispenser flap of the package of FIGS. 13 and 14.
Figure 16:
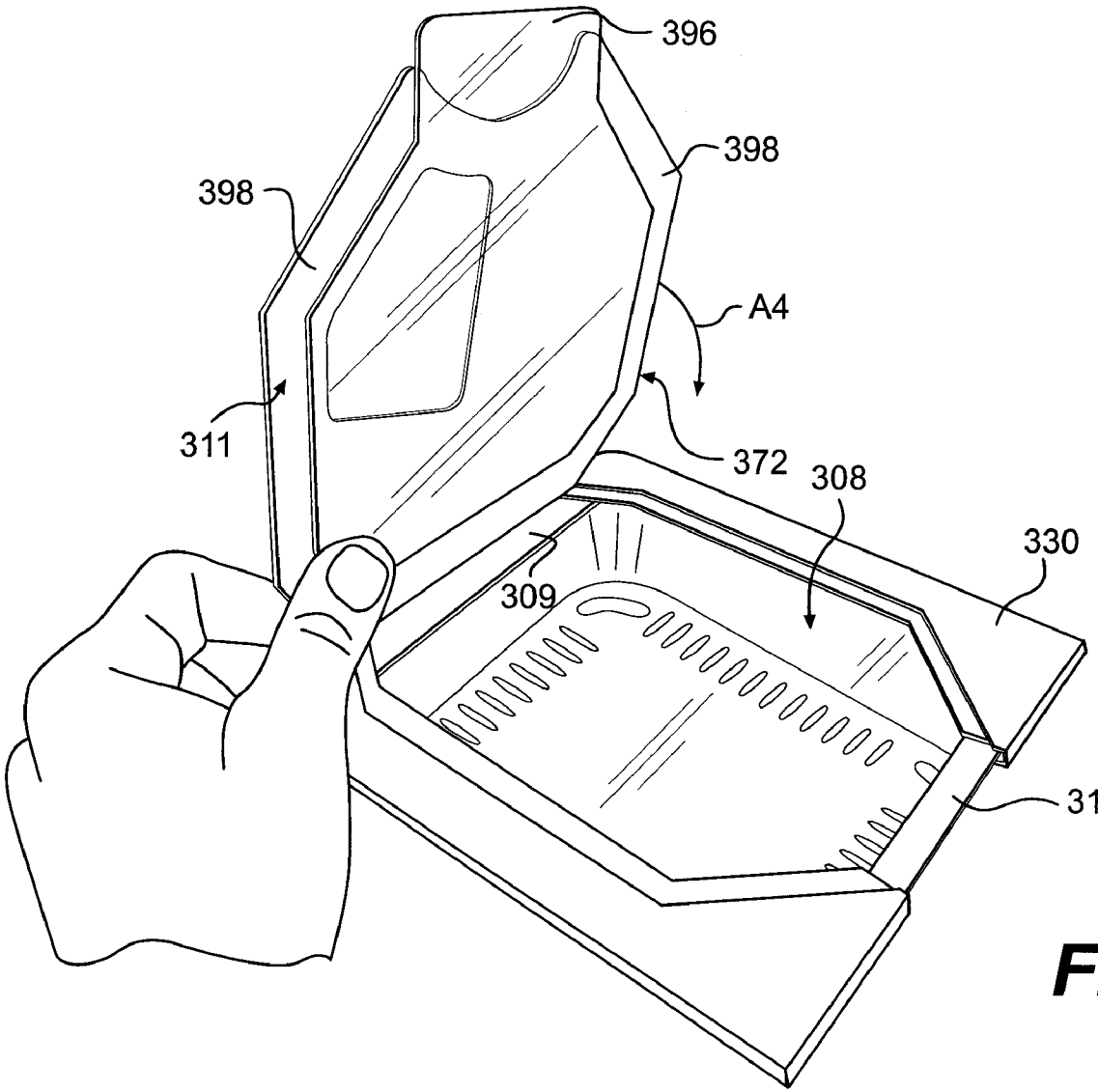

As shown in FIGS. 15 and 16, the package 307 can be opened by grasping the actuation tab 396 and lifting the dispenser flap 311 upward in the direction of arrow A3. The adhesive on the marginal portion 398 of the carton flap 372 allows the dispenser flap 311 to be sealed by way of downwardly folding the flap in the direction of arrow A4 (FIG. 17). The dispenser flap 311 can have other resealable features without departing from the scope of this disclosure. For example, adhesive (e.g., releasable or non-releasable) in the marginal portion 398 of the carton flap 372 can be replaced with other attachment/sealing mechanisms.

Although the embodiment of FIGS. 1-4 is shown and described with an inner layer of material 9 and an intermediate layer of material 92, and the embodiment of FIGS. 6-16 is described and shown with an inner layer of material or liner 9 and no intermediate layer of material, it is possible for either embodiment to either include or not include an intermediate layer of material. Thus, either embodiment may have a dispenser flap comprising an outer flap, an intermediate flap and an inner flap as disclosed in the embodiment of FIGS. 1-4, or a dispenser flap comprising only an outer flap and an inner flap as described in the embodiment of FIGS. 6-16.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described above. The blanks can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, cut line, or the like. For example, a cut line can be a continuous slit or could be wider than a slit without departing from the present disclosure.

The foregoing description illustrates and describes various embodiments of the present disclosure. As various changes could be made in the above construction, it is intended that all matter contained in the above description or shown in the accompanying drawings shall be interpreted as illustrative and not in a limiting sense. It will be understood by those skilled in the art that while the present disclosure has been discussed above with reference to exemplary embodiments, various additions, modifications and changes can be made thereto without departing from the spirit and scope of the disclosure.

The present disclosure describes various carton or packages that have a reclosable flap. In some embodiments, the flap have a closure mechanism that maintains the flap in the closed position. In some embodiments, the package and flap may comprise a liner. The closure mechanism can include a resealable mechanism, such as a label, and can be manufactured from any suitable process (e.g., lamination, extrusion, etc.). Further the adhesive film or label can be a separate layer of material that covers an aperture of a liner or film in the interior of the carton. Further the closure mechanisms could include other resealable mechanisms such as adhesive directly applied to the carton flap such that a separate label is not needed. Further, the liner and label both could be omitted so that the carton flap is reclosable and/or resealable by other mechanisms (e.g., adhesive or mechanical closure features such as a locking projection on the flap that is received in a correspondingly sized and shaped opening in the carton to secure the carton flap in the closed position.

What is claimed is:

1. A package for holding a product, comprising:

a carton comprising a plurality of panels, the plurality of panels including a dispenser panel;

an inner layer of material attached to an inner surface of the dispenser panel; and a dispenser flap comprising an inner flap defined in the inner layer of material;

an outer flap defined in the dispenser panel, the outer flap being attached to the inner flap, and the outer flap being releasably attached to a portion of the inner layer of material adjacent the inner flap; and an intermediate layer of material disposed between the inner layer of material and the dispenser panel, the intermediate layer of material being adhesively attached to the inner layer of material and the dispenser panel so as to attach the inner layer of material to the dispenser panel;

wherein, in order to open the dispenser flap to provide access to an interior of the carton, the outer flap is at least partially detachable from the dispenser panel and the portion of the inner layer of material adjacent the inner flap, and the inner flap is at least partially detachable from the inner layer of material; and wherein the outer flap can be reattached to the portion of the inner layer of material adjacent the inner flap in order to close the dispenser flap after the dispenser flap has been opened.

2. The package of claim 1, wherein the inner flap comprises a tab extending through an opening in the dispenser panel, and wherein the tab forms an actuator operable to at least partially detach the inner flap from the inner layer of material.

3. The package of claim 2, wherein the dispenser flap is configured such that at least partially detaching the inner flap from the inner layer of material causes the outer flap to at least partially detach from the dispenser panel and the portion of the inner layer of material adjacent the inner flap.

4. The package of claim 1, wherein the outer flap and the inner flap are at least partially defined by respective tear lines, and wherein the outer flap is at least partially detachable from the dispenser panel and the inner flap is at least partially detachable from the inner layer of material at the respective tear lines.

5. The package of claim 1, wherein the inner layer of material is adhesively attached to the inner surface of the dispenser panel, and the outer flap is adhesively, releasably attached to the portion of the inner layer of material adjacent the inner flap.

6. The package of claim 1, wherein the inner layer of material substantially covers an entire surface area of the inner surface of the dispenser panel.

7. The package of claim 1, wherein the carton comprises a front panel, a back panel, side panels and end panels, and wherein the front panel is the dispenser panel.

8. The package of claim 1, wherein the inner layer of material is a film.

9. The package of claim 8, wherein the inner layer of material is substantially transparent, and wherein the outer flap comprises an opening through which a portion of the inner layer of material is visible.

10. The package of claim 1, wherein the outer flap has a surface area that is greater than a surface area of the inner flap.

11. The package of claim 1, comprising a tray secured to the carton, the tray comprising a bottom wall, side walls and a top opening, wherein:

the dispenser panel and the inner layer of material extend over the top opening; and the inner layer of material is attached to the tray such that the dispenser panel forms a lid for sealing the top opening.

12. The package of claim 11, wherein:

the dispenser panel is a top panel of the carton;

the carton comprises a bottom panel having a bottom opening, the bottom panel being spaced from the top panel and extending substantially parallel to the top panel, a first side panel connected to the top panel and the bottom panel, and extending substantially perpendicular to the top panel, a second side panel connected to the top panel and extending substantially perpendicular to the top panel, a third side panel connected to the top panel and extending substantially perpendicular to the top panel, a fourth side panel connected to the top panel and extending substantially perpendicular to the top panel, a first closure flap connected to the second side panel and secured in face-to-face contact with the bottom panel, a second closure flap connected to the third side panel and secured in face-to-face contact with the bottom panel, and a third closure flap connected to the fourth side panel and secured in face-to-face contact with the bottom panel;

the bottom wall and portions of the side walls extend outwardly from the carton through the bottom opening; and the tray comprises a flange extending from a top of the side walls and positioned between the top panel and the bottom panel.

13. The package of claim 12, comprising a plurality of retention flaps connected to the bottom panel and positioned adjacent the bottom opening, wherein the retention flaps engage the side walls.

14. The package of claim 12, wherein the first, second and third closure flaps are adhesively attached to the bottom panel.

15. The package of claim 11, wherein the carton is constructed of paperboard and the tray is constructed of plastic.

16. The package of claim 1, wherein:

the dispenser flap comprises an intermediate flap defined in the intermediate layer of material, the intermediate flap being adhesively attached to the outer flap and the inner flap so as to attach the outer flap to the inner flap, and the intermediate flap being releasably attached to the portion of the inner layer of material adjacent the inner flap so as to releasably attach the outer flap to the portion of the inner layer of material adjacent the inner flap;

the intermediate flap is at least partially detachable from the intermediate layer of material and the portion of the inner layer of material adjacent the inner flap in order to open the dispenser flap to provide access to the interior of the carton; and the intermediate flap can be reattached to the portion of the inner layer of material adjacent the inner flap in order to close the dispenser flap after the dispenser flap has been opened.

17. The package of claim 16, wherein the intermediate flap has a surface area that is greater than a surface area of the inner flap.

18. The package of claim 16, wherein the intermediate flap comprises a tab extending through an opening in the dispenser panel, and wherein the tab forms an actuator for at least partially detaching the intermediate flap from the intermediate layer of material and the portion of the inner layer of material adjacent the inner flap.

19. The package of claim 18, wherein the dispenser flap is configured such that detaching the intermediate flap from the intermediate layer of material and the portion of the inner layer of material adjacent the inner flap causes the outer flap and the inner flap to at least partially detach from the dispenser panel and the inner layer of material, respectively.

20. The package of claim 16, wherein:

the outer flap, the intermediate flap and the inner flap are at least partially defined by respective tear lines; and the outer flap is at least partially detachable from the dispenser panel, the intermediate flap is at least partially detachable from the intermediate layer of material, and the inner flap is at least partially detachable from the inner layer of material at the respective tear lines.

21. The package of claim 16, wherein the intermediate layer of material and the inner layer of material are adhered together by adhesive.

22. The package of claim 16, wherein the intermediate layer of material substantially covers an entire surface area of the inner surface of the dispenser panel.

23. The package of claim 16, wherein the intermediate layer of material is a biaxially oriented polypropylene material.

24. The package of claim 16, wherein the intermediate layer of material and the inner layer of material are films.

25. The package of claim 24, wherein the intermediate layer of material and the inner layer of material are substantially transparent, and wherein the outer flap comprises an opening through which portions of the inner and intermediate layers of material are visible.

26. The package of claim 25, wherein the inner layer of material is a bag and the intermediate layer of material is a film.

27. The package of claim 1, wherein the dispenser flap is partially separable from the package and pivotable with respect to the package in order to open the dispenser flap.

28. A package assembly for forming a package for holding a product, the package assembly comprising a carton blank assembly comprising:

a carton blank including a plurality of panels foldable to form a carton, the plurality of panels including a dispenser panel;

an inner layer of material attached to an inner surface of the dispenser panel; and a dispenser flap comprising an inner flap defined in the inner layer of material and at least partially detachable from the inner layer of material;

an outer flap defined in the dispenser panel and at least partially detachable from the dispenser panel, the outer flap being attached to the inner flap, and the outer flap being releasably attached to a portion of the inner layer of material adjacent the inner flap; and an intermediate layer of material disposed between the inner layer of material and the dispenser panel, the intermediate layer of material being adhesively attached to the inner layer of material and the dispenser panel so as to attach the inner layer of material to the dispenser panel.

29. The package assembly of claim 28, wherein the inner flap comprises a tab extending through an opening in the dispenser panel, and wherein the tab forms an actuator operable to at least partially detach the inner flap from the inner layer of material.

30. The package assembly of claim 29, wherein the dispenser flap is configured such that at least partially detaching the inner flap from the inner layer of material causes the outer flap to at least partially detach from the dispenser panel and the portion of the inner layer of material adjacent the inner flap.

31. The package assembly of claim 28, wherein the outer flap and the inner flap are at least partially defined by respective tear lines, and wherein the outer flap is at least partially detachable from the dispenser panel and the inner flap is at least partially detachable from the inner layer of material at the respective tear lines.

32. The package assembly of claim 28, wherein the inner layer of material is adhesively attached to the inner surface of the dispenser panel, and the outer flap is adhesively, releasably attached to the portion of the inner layer of material adjacent the inner flap.

33. The package assembly of claim 28, wherein the inner layer of material substantially covers an entire surface area of the inner surface of the dispenser panel.

34. The package assembly of claim 28, wherein the carton comprises a front panel, a back panel, side panels and end panels, and wherein the front panel is the dispenser panel.

35. The package assembly of claim 28, wherein the inner layer of material is a film.

36. The package assembly of claim 35, wherein the inner layer of material is substantially transparent, and wherein the outer flap comprises an opening through which a portion of the inner layer of material is visible.

37. The package assembly of claim 28, wherein the outer flap has a surface area that is greater than a surface area of the inner flap.

38. The package assembly of claim 28, comprising a tray configured to be secured to the carton, the tray comprising a bottom wall, side walls, and a top opening defined within a perimeter of the top edge, wherein:

the dispenser panel is configured to extend over the top opening; and the inner layer of material is configured to be attached to the tray such that the dispenser panel forms a lid for sealing the top opening.

39. The package assembly of claim 38, wherein:

the dispenser panel is a top panel of the carton blank;

the carton blank comprises a bottom panel having a bottom opening, the bottom panel being foldable so as to be spaced from and parallel to the top panel, a first side panel connected to the top panel and the bottom panel, the first side panel being foldable to extend substantially perpendicular to the top panel, a second side panel connected to the top panel, the second side panel being foldable to extend substantially perpendicular to the top panel, a third side panel connected to the top panel, the third side panel being foldable to extend substantially perpendicular to the top panel, a fourth side panel connected to the top panel, the fourth side panel being foldable to extend substantially perpendicular to the top panel, a first closure flap connected to the second side panel, the first closure flap being foldable into face-to-face contact with the bottom panel, a second closure flap connected to the third side panel, the second closure flap being foldable into face-to-face contact with the bottom panel, and a third closure flap connected to the fourth side panel, the third closure flap being foldable into face-to-face contact with the bottom panel;

the bottom wall and portions of the side walls are configured to be received through the bottom opening; and the tray comprises a flange extending from a top of the side walls and configured to be positioned between the top panel and the bottom panel.

40. The package assembly of claim 39, comprising a plurality of retention flaps connected to the bottom panel and positioned adjacent the bottom opening, wherein the retention flaps engage the side walls.

41. The package assembly of claim 39, wherein the first, second and third closure flaps are adhesively attached to the bottom panel.

42. The package assembly of claim 38, wherein the carton blank is constructed of paperboard and the tray is constructed of plastic.

43. The package assembly of claim 28, wherein:

the dispenser flap comprises an intermediate flap defined in the intermediate layer of material and at least partially detachable from the intermediate layer of material, the intermediate flap being adhesively attached to the outer flap and the inner flap so as to attach the outer flap to the inner flap, and the intermediate flap being releasably attached to the portion of the inner layer of material adjacent the inner flap so as to releasably attach the outer flap to the portion of the inner layer of material adjacent the inner flap.

44. The package assembly of claim 43, wherein the intermediate flap has a surface area that is greater than a surface area of the inner flap.

45. The package assembly of claim 43, wherein the intermediate flap comprises a tab extending through an opening in the dispenser panel, and wherein the tab forms an actuator for at least partially detaching the intermediate flap from the intermediate layer of material and the portion of the inner layer of material adjacent the inner flap.

46. The package assembly of claim 45, wherein the dispenser flap is configured such that detaching the intermediate flap from the intermediate layer of material and the portion of the inner layer of material adjacent the inner flap causes the outer flap and the inner flap to at least partially detach from the dispenser panel and the inner layer of material, respectively.

47. The package assembly of claim 43, wherein:

the outer flap, the intermediate flap and the inner flap are at least partially defined by respective tear lines; and the outer flap is at least partially detachable from the dispenser panel, the intermediate flap is at least partially detachable from the intermediate layer of material, and the inner flap is at least partially detachable from the inner layer of material at the respective tear lines.

48. The package assembly of claim 43, wherein the intermediate layer of material and the inner layer of material are adhered together by adhesive.

49. The package assembly of claim 43, wherein the intermediate layer of material substantially covers an entire surface area of the inner surface of the dispenser panel.

50. The package assembly of claim 43, wherein the intermediate layer of material is a biaxially oriented polypropylene material.

51. The package assembly of claim 43, wherein the intermediate layer of material and the inner layer of material are films.

52. The package assembly of claim 51, wherein the intermediate layer of material and the inner layer of material are substantially transparent.

53. The package assembly of claim 43, wherein:

the dispenser flap is configured to be opened by at least partially detaching the outer flap from the dispenser panel, at least partially detaching the intermediate flap from the intermediate layer of material and the portion of the inner layer of material adjacent the inner flap, and at least partially detaching the inner flap from the inner layer of material; and the dispenser flap is configured to be closed after being opened by reattaching the intermediate flap to the portion of the inner layer of material adjacent the inner flap.

54. The package assembly of claim 28, wherein the inner layer of material is a bag and the intermediate layer of material is a film.

55. The package assembly of claim 28, wherein the dispenser flap is partially separable from the carton assembly and pivotable with respect to the carton assembly in order to open the dispenser flap.

56. The method of claim 55, wherein:

the inner flap comprises an actuator tab protruding from an opening in the dispenser panel;

pulling the actuator tab at least partially causes the inner flap to at least partially detach from the inner layer of material and the outer flap to at least partially detach from the dispenser panel and the portion of the inner layer of material adjacent the inner flap.

57. The package assembly of claim 28, wherein:

the dispenser flap is configured to be opened by at least partially detaching the outer flap from the dispenser panel and the portion of the inner layer of material adjacent the inner flap, and at least partially detaching the inner flap from the inner layer of material; and the dispenser flap is configured to be closed after being opened by reattaching the outer flap to the portion of the inner layer of material adjacent the inner flap.

58. A method of removing contents from a package, comprising:

providing a package comprising a carton comprising a plurality of panels, the plurality of panels including a dispenser panel, an inner layer of material attached to an inner surface of the dispenser panel, and a dispenser flap comprising an inner flap defined in the inner layer of material, and an outer flap defined in the dispenser panel, the outer flap being attached to the inner flap, and the outer flap being releaseably attached to a portion of the inner layer of material adjacent the inner flap; and an intermediate layer of material disposed between the inner layer of material and the dispenser panel, the intermediate layer of material being adhesively attached to the inner layer of material and the dispenser panel so as to attach the inner layer of material to the dispenser panel;

opening the dispenser flap to provide access to an interior of the carton, wherein opening the dispenser flap comprises at least partially detaching the inner flap from the inner layer of material and at least partially detaching the outer flap from the dispenser panel and the portion of the inner layer of material adjacent the inner flap;

removing contents from the package through the dispenser opening; and c losing the dispenser flap, wherein closing the dispenser flap comprises reattaching the outer flap to the portion of the inner layer of material adjacent the inner flap.

59. The method of claim 58, wherein opening the dispenser flap comprises pivoting the dispenser flap.

60. The method of claim 57, wherein closing the dispenser flap comprises pivoting the dispenser flap prior to reattaching the outer flap to the portion of the inner layer of material adjacent the inner flap.

61. The method of claim 58, wherein the outer flap is releaseably attached to the portion of the inner layer of material adjacent the inner flap with adhesive, and wherein the adhesive is used for reattaching the outer flap to the portion of the inner layer of material adjacent the inner flap.

62. The method of claim 58, wherein:

the outer flap and the inner flap are at least partially defined by respective tear lines; and at least partially detaching the inner flap from the inner layer of material and at least partially detaching the outer flap from the dispenser panel and the portion of the inner layer of material adjacent the inner flap comprises breaching the respective tear lines.

63. The method of claim 58, wherein:

the package comprises a tray secured to the carton, the tray comprising a bottom wall, side walls and a top opening defined within a perimeter of the top edge;

the dispenser panel and the inner layer of material extend over the top opening; and the inner layer of material is attached to the tray such that the dispenser panel forms a lid for sealing the top opening.

64. The method of claim 58, wherein:

the dispenser flap comprises an intermediate flap defined in the intermediate layer, the intermediate flap being adhesively attached to the outer flap and the inner flap so as to attach the outer flap to the inner flap, and the intermediate flap being releaseably attached to the portion of the inner layer of material adjacent the inner flap so as to releaseably attach the outer flap to the portion of the inner layer of material adjacent the inner flap;

at least partially detaching the outer flap from the portion of the inner layer of material adjacent the inner flap comprises at least partially detaching the intermediate flap from the intermediate layer of material and the portion of the inner layer of material adjacent the inner flap; and reattaching the outer flap to the portion of the inner layer of material adjacent the inner flap comprises reattaching the intermediate flap to the portion of the inner layer of material adjacent the inner flap.

65. The method of claim 64, wherein the intermediate flap is releaseably attached to the portion of the inner layer of material adjacent the inner flap with adhesive, and wherein the adhesive is used for reattaching the intermediate flap to the portion of the inner layer of material adjacent the inner flap.

66. The method of claim 64, wherein:

the intermediate flap comprises an actuator tab protruding from an opening in the dispenser panel;

pulling the actuator tab at least partially causes the inner flap to at least partially detach from the inner layer of material, the intermediate flap to at least partially detach from the intermediate layer of material and the portion of the inner layer of material adjacent the inner flap, and the outer flap to at least partially detach from the dispenser panel.

67. The method of claim 66, wherein:

the outer flap, the intermediate flap and the inner flap are at least partially defined by respective tear lines; and at least partially detaching the inner flap from the inner layer of material, at least partially detaching the intermediate flap fromthe intermediate layer of material and the portion of the inner layer of material adjacent the inner flap, and at least partially detaching the outer flap from the dispenser panel comprise breaching the respective tear lines.

68. A package for holding a product, comprising:

a carton comprising a plurality of panels, the plurality of panels including a dispenser panel;

an inner layer of material attached to an inner surface of the dispenser panel; and a dispenser flap comprising an inner flap defined in the inner layer of material and at least partially detachable from the inner layer of material;

an outer flap defined in the dispenser panel and at least partially detachable from the dispenser panel, the outer flap being attached to the inner flap, and the outer flap being releaseably attached to a portion of the inner layer of material adjacent the inner flap; and an intermediate layer of material disposed between the inner layer of material and the dispenser panel, the intermediate layer of material being adhesively attached to the inner layer of material and the dispenser panel so as to attach the inner layer of material to the dispenser panel.

69. The package of claim 68, comprising a tray secured to the carton, the tray comprising a bottom wall, side walls and a top opening, wherein:

the dispenser panel and the inner layer of material extend over the top opening; and the inner layer of material is attached to the tray such that the dispenser panel forms a lid for sealing the top opening.

70. The package of claim 68, wherein:

the dispenser flap comprises an intermediate flap defined in the intermediate layer and at least partially detachable from the intermediate layer of material, the intermediate flap being adhesively attached to the outer flap and the inner flap so as to attach the outer flap to the inner flap, and the intermediate flap being releasably attached to the portion of the inner layer of material adjacent the inner flap so as to releasably attach the outer flap to the portion of the inner layer of material adjacent the inner flap.

* * * * *